US007066866B1

(12) United States Patent
Mobley

(10) Patent No.: US 7,066,866 B1
(45) Date of Patent: Jun. 27, 2006

(54) CHIN UP BAR ASSEMBLY WITH SLIDING AND SWIVELING HANDLES

(76) Inventor: Mitch T. Mobley, 600 S. Grimmell Rd., Jefferson, IA (US) 50129

( * ) Notice: Subject to any disclaimer, the term of this patent is extended or adjusted under 35 U.S.C. 154(b) by 389 days.

(21) Appl. No.: 10/616,576

(22) Filed: Jul. 10, 2003

(51) Int. Cl.
*A83B 21/068* (2006.01)
*A83B 1/00* (2006.01)

(52) U.S. Cl. ..... 482/40; 482/96; 482/904; 482/908

(58) Field of Classification Search ..... 482/23, 482/34–40, 45, 92–96, 106, 904, 908; 16/422; 248/298.1, 925, 217.1, 214, 222.13, 231.51; 403/109.8; 182/136
See application file for complete search history.

(56) References Cited

U.S. PATENT DOCUMENTS 3,156,465 A * 11/1964 Jacobi ..... 482/37
3,226,115 A * 12/1965 Underhill ..... 482/62
3,342,484 A * 9/1967 Christensen ..... 482/24
3,497,882 A * 3/1970 Weeks ..... 482/148
3,825,252 A * 7/1974 Geiger ..... 482/129
4,487,412 A * 12/1984 Meeko ..... 482/139
4,487,413 A * 12/1984 Fall ..... 482/91
4,620,701 A * 11/1986 Mojden ..... 482/41
4,949,956 A * 8/1990 Pobran ..... 482/38
5,300,002 A * 4/1994 Freye ..... 482/114
5,588,942 A * 12/1996 Dillard ..... 482/139
6,217,483 B1 * 4/2001 Kallassy ..... 482/38
6,503,175 B1 * 1/2003 Harrell ..... 482/38

* cited by examiner

*Primary Examiner*—Stephen K. Cronin
*Assistant Examiner*—Victor K. Hwang
(74) *Attorney, Agent, or Firm*—McKee, Voorhees & Sease, P.L.C.

(57) ABSTRACT

A chin up bar assembly is provided with a cross bar and a pair of handles slidably mounted on the cross bar. The handles are pivotally mounted for movement between locked and unlocked positions. When a user hangs from the handles, the handles automatically pivot to the locked position to frictionally engage the cross bar and prevent sliding movement of the handles along the cross bar. The handles also can be swiveled during use to exercise different muscles in the user's arms, chest and back.

22 Claims, 4 Drawing Sheets

CHIN UP BAR ASSEMBLY WITH SLIDING AND SWIVELING HANDLES

BACKGROUND OF THE INVENTION

Chin up bars have been known for many years and in general include a cross bar which can be grasped by a user to do chin ups. The user's hands may be spaced at any desired width on the bar to exercise various muscles in the user's arms, back and chest.

More recently, chin up bars have been provided with handles which are slidable along the cross bar so as to adjust the spacing between the user's hands. Such sliding handles include a pin or similar structure received in one of a plurality of holes in the cross bar so as to lock the handles in a selected position. However, such pins are often difficult to actuate or release, and the spacing between the handles is limited to the pre-determined holes in the cross bar.

Therefore, the primary objective of the present invention is the provision of an improved chin up bar assembly.

Another objective of the present invention is the provision of a chin up bar assembly having handles which are slidably mounted on the cross bar and held in a selected position by the user's weight.

A further objective of the present invention is the provision of a chin up bar assembly having a pair of handles with swiveling handgrips.

Still another objective of the present invention is the provision of a method for setting a pair of chin up handles at a selected position along a cross bar using only the user's weight.

Still another objective of the present invention is the provision of a chin up bar assembly having sliding and swiveling handles.

Another objective of the present invention is the provision of a chin up bar assembly having handles which can be selectively positioned without the use of tools.

Still another objective of the present invention is the provision of an improved chin up bar assembly which is quickly and easily adjustable.

Yet another objective of the present invention is the provision of a chin up bar assembly which is economical to manufacture, and durable and safe in use.

These and other objectives will become apparent from the following descriptions of the invention.

BRIEF SUMMARY OF THE INVENTION

The chin up bar assembly of the present invention includes a cross bar and a pair of handles slidably mounted on the cross bar. The handles are pivotally mounted to the cross bar so as to be movable between locked and unlocked positions. In the unlocked position, the handles are slidable along the cross bar, and in the locked position the handles are prevented from sliding along the cross bar. The handles are held in a selected position along the cross bar by a user's weight. The handles are independently slidable along the cross bar. The handles include handgrips which swivel about a substantially vertical axis.

The present invention is also directed towards a method of setting a pair of chin up handles at a selected position along a cross bar. The method includes the initial step of sliding each handle to a selected position along the bar, then moving each handle to a locked position using only the weight of the user so as to preclude sliding of the handles along the cross bar. The movement to the locked position is achieved by gripping a handgrip of each handle such that the weight of the user pivots a portion of the handle into frictional engagement with the cross bar. When the user is not hanging from the handles, the handles can be pivoted to an unlocked position disengaged from the cross bar to allow sliding movement of the handles along the cross bar.

DETAILED DESCRIPTION OF THE PREFERRED EMBODIMENT

Figure 1:
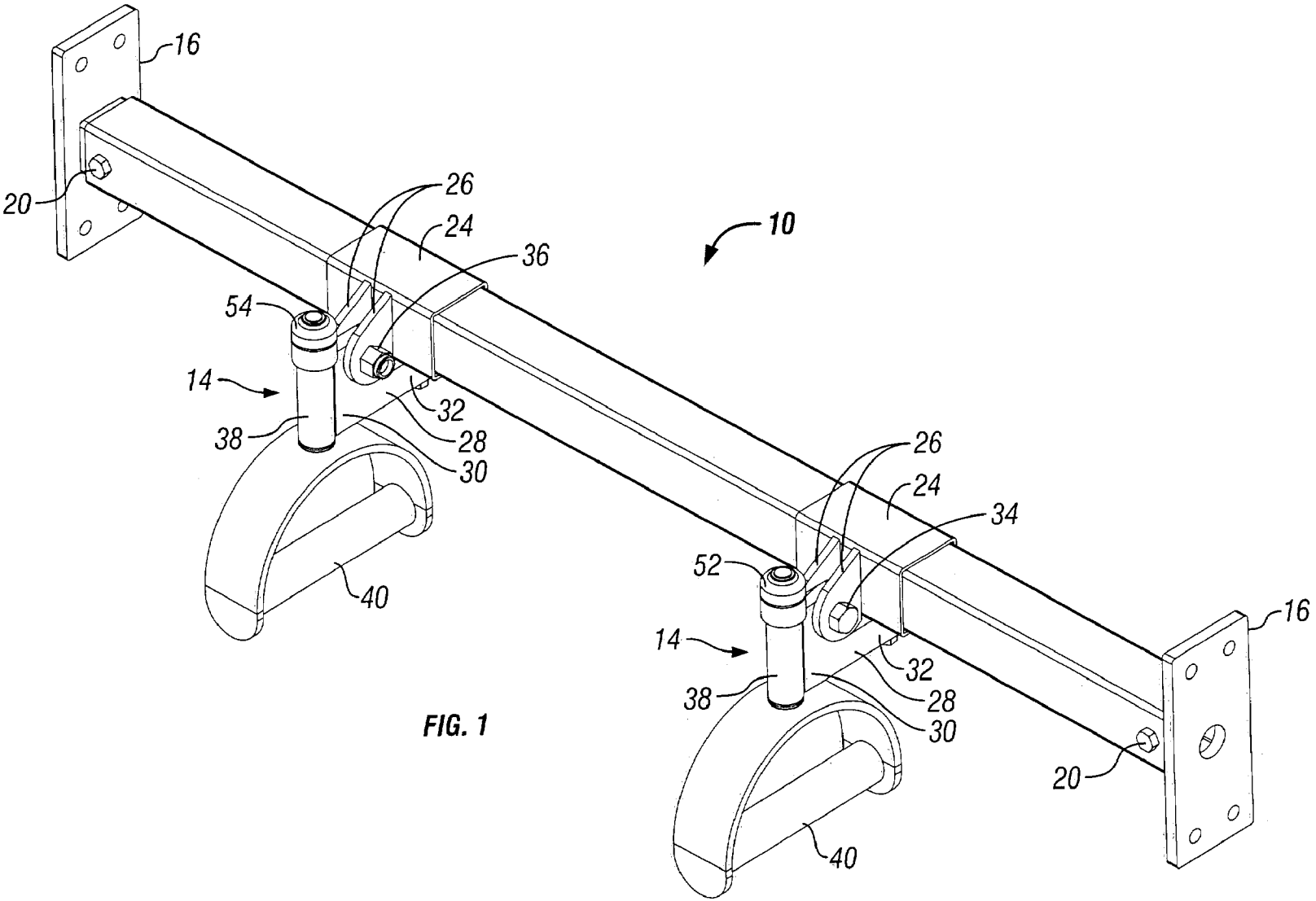
FIG. 1 is a perspective view of the chin up bar assembly of the present invention with the handles being in a locked position.

The improved chin up bar assembly of the present invention is designated in the drawings by the reference numeral 10. The assembly 10 generally includes a cross bar 12 and a pair of handles 14 slidably mounted on the bar 12. Preferably, the cross bar 12 is a square tubular member, as shown in the drawings. However, it is understood that cross bar 12 may be round and/or solid.

Figure 3:
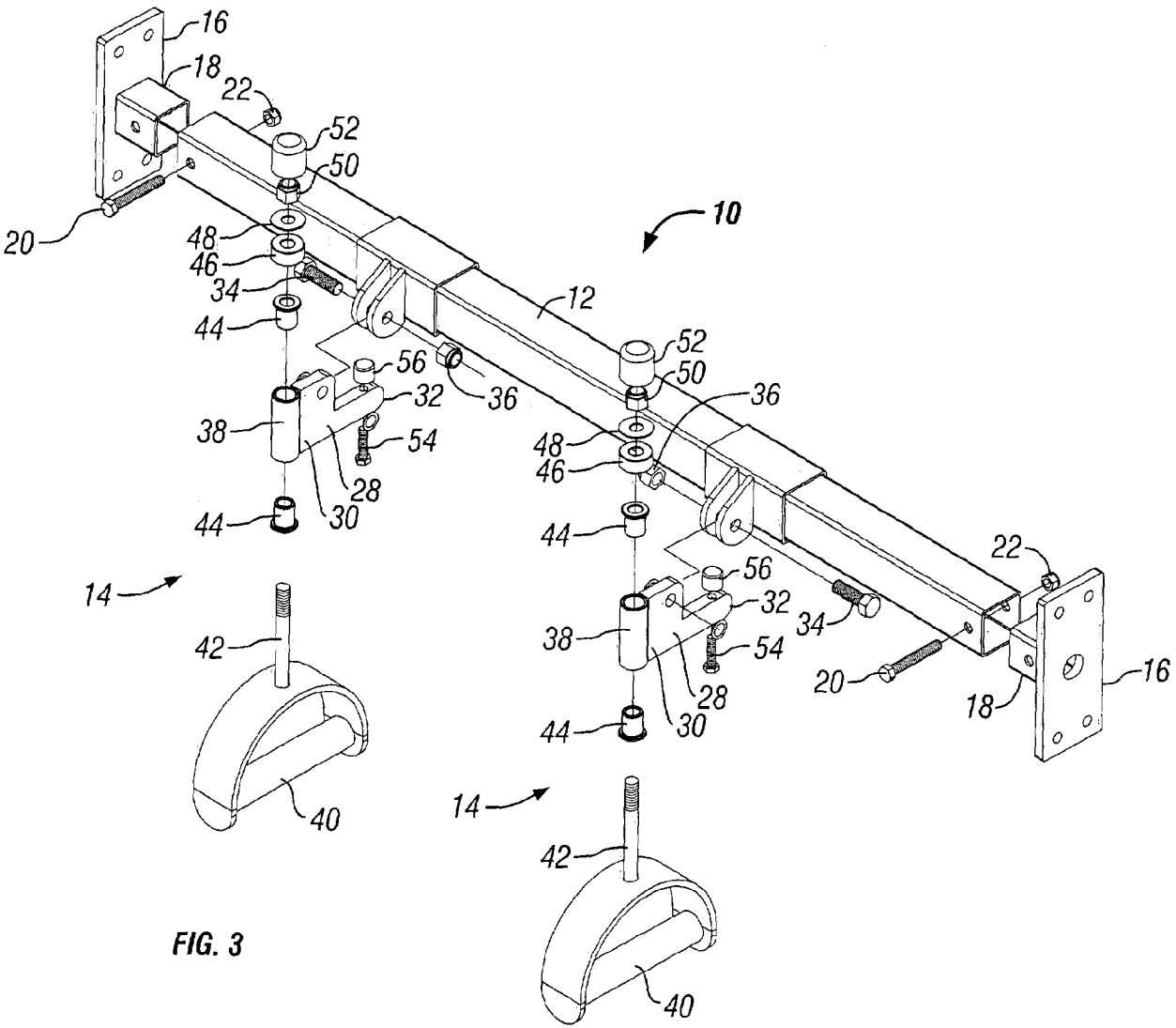
FIG. 3 is a exploded view of the chin up bar of the present invention.

As seen in FIG. 3, a pair of end plates 16 each have a stub shaft 18 which matingly fits into the end of the cross bar 12 and is secured by a bolt 20 and a nut 22. The end plates 16 are adapted to be mounted to uprights (not shown) so as to support the cross bar 12 at a desired height above the ground or floor.

Figure 4:
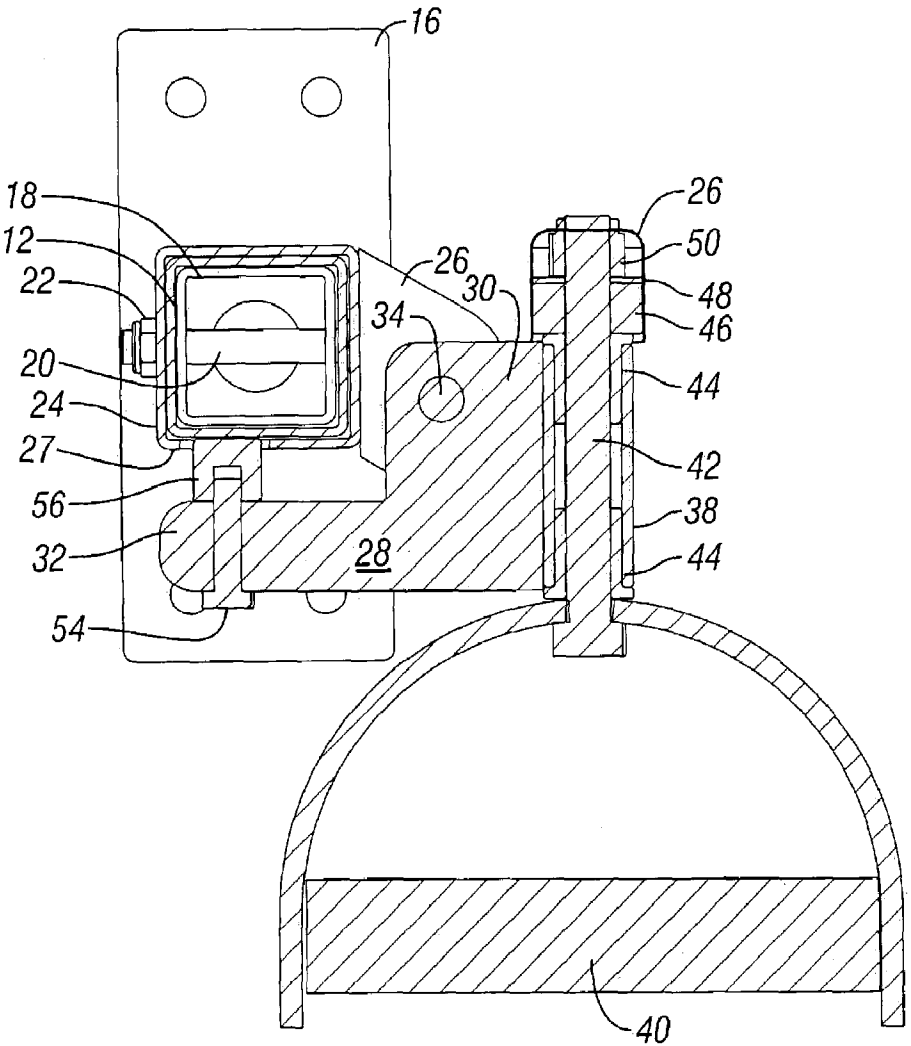
FIG. 4 is a sectional view taken along a vertical plane extending through one of the handles.

A pair of collars 24 are slidably mounted on the cross bar 12. Each collar 24 includes a pair of ears 26. Each collar 24 has a hole 27 in the lower surface thereof, as seen in FIG. 4.

Each handle 14 includes an arm 28 with opposite first and second ends 30, 32. The arm 28 is received between the ears 26 of the collar 24, and pivotally secured thereto with a pin or bolt 34 and nut 36.

The first end 30 of the arm 28 includes a substantially vertically oriented tube or collar 38. Each handle 14 also includes a handgrip 40 supported by a shaft 42 journaled within the tube 38. Thus, the handgrips 40 swivel or pivot around the axis of the shaft 42. A bushing 44 is provided at the upper and lower ends of the tube 38. A thrust bearing 46 and washer 48 are provided at the upper end of the shaft 42, which is threaded so as to receive a nut 50. A cap 52 covers the spacer 46, washer 48 and nut 50.

A pin or bolt 54 extends upwardly through the second end 32 of the arm 28. The upper end of the pin or bolt 54 threadably receives a rubber bumper or cap 56.

Figure 2:
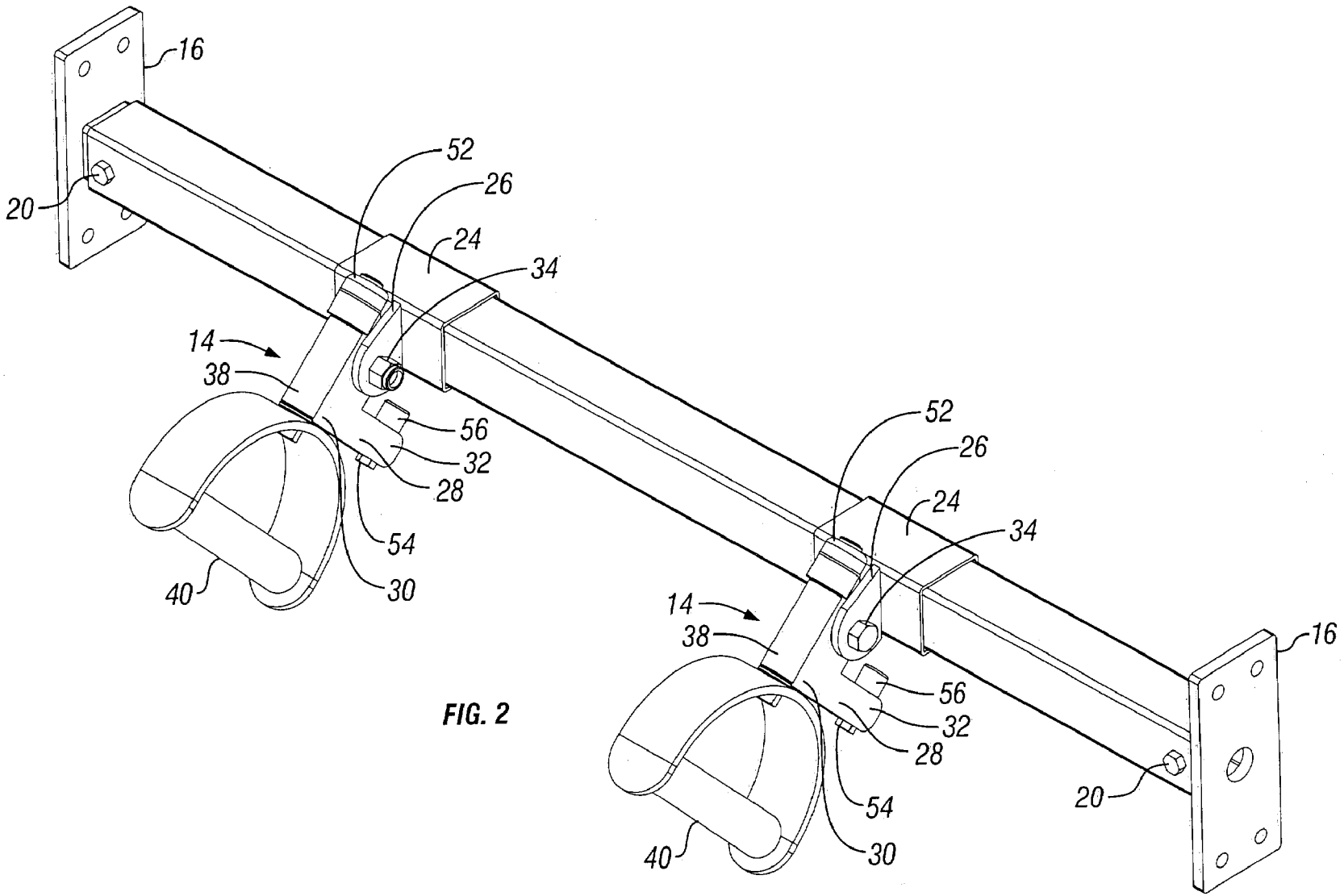
FIG. 2 is a perspective view of the chin up bar assembly of the present invention with the handles being in an unlocked position.

In use, handles 14 are movable between a locked position, as shown in FIG. 1, and an unlocked position, as shown in FIG. 2. More particularly, each handle 14 pivots about the horizontal axis of the bolts 34. Before hanging from the handgrips 40, a user can slide the handles 14 to a selected position along the cross bar 12 simply by moving the handles 14 towards the unlocked position. The handles 14 are independently movable along the cross bar 12. When a user grasps the handgrips 40 and hangs, the user's weight automatically pivots the handles 14 about the substantially horizontal axis of the bolts 34 to the locked position, wherein the cap 56 extends through the holes 27 in the bottom of the collars 24 so as to frictionally engage the bottom of the cross bar 12. The arm 28 functions as a fulcrum, with the user's weight exerting a downward force on the first end 30 of the arm and a corresponding upward force on the second end 32 of the arm 28. Thus, the handles 14 can be positioned anywhere along the cross bar 12, with the user's weight then automatically locking the handles 14 in the selected position.

During use, the handgrips 40 can also be swiveled about the substantially vertical axis of the shaft 42 so as to exercise different muscles in the user's arms, chest and back. The thrust bearing 46 allows for virtually no friction when the handgrips 40 are swiveled.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A chin up bar assembly, comprising:

a cross bar;

a pair of collars slidably mounted on the cross bar;

a pair of handles pivotally mounted on the collars;

the handles being held in a selected position substantially at any point along the cross bar by application of a portion of a user's weight to the handles.

2. The assembly of claim 1 wherein the handles are pivotal between locked and unlocked positions.

3. The assembly of claim 1 wherein the handles are movable relative to the collars between an unlocked position for sliding along the cross bar, and a locked position for preventing sliding along the cross bar.

4. The assembly of claim 1 wherein the handles are pivotal relative to the collars about horizontal and vertical shafts.

5. The assembly of claim 1 wherein each handle includes an arm having opposite first and second ends and the arm being pivotally mounted to one of the collars at a point between the opposite ends for rotation about an axis parallel to the cross bar.

6. The assembly of claim 5 wherein each handle includes a handgrip mounted to the first end of the arm whereby the user's weight will pivot the second end of the arm into frictional engagement with the cross bar so as to lock the handle against sliding movement.

7. The assembly of claim 5 wherein the first end of each arm includes a tube and each handle includes a handgrip with a shaft pivotally received in the tube, whereby the handgrip is pivotal while the handle is fixed against sliding movement along the bar.

8. The assembly of claim 1 wherein the handles include handgrips spaced forwardly from the cross bar.

9. The assembly of claim 8 wherein the handles each includes an arm pivotally mounted to the cross bar about a horizontal shaft to define a fulcrum.

10. The assembly of claim 1 wherein the handles engage a bottom surface of the cross bar to lock the handles in position and preclude sliding movement of the handles along the cross bar.

11. A method of setting a pair of chin up handles at a selected position along a cross bar, comprising:

sliding each handle to a selected position along the bar;

pivoting each handle to a locked position such that a user's weight alone precludes sliding of the handles along the cross bar, wherein each handle includes a collar slidably mounted to the cross bar.

12. The method of claim 11 wherein movement to the locked position is achieved by gripping a handgrip of each handle such that the weight of the user pivots a portion of the handle into frictional engagement with the cross bar.

13. The method of claim 11 further comprising swiveling the handles about a substantially vertical axis to a desired orientation.

14. The method of claim 11 further comprising moving each handle to an unlocked position wherein the handle is disengaged from the cross bar to allow sliding movement of the handle along the cross bar.

15. The method of claim 11 further comprising engaging a bottom surface of the cross bar with the handles to retain the handles in a locked position.

16. The method of claim 11 wherein each handle includes a handgrip, the method further comprising positioning the hand grips forwardly firm the cross bar.

17. A chin up bar assembly, comprising:

a cross bar;

a pair of collars slidably mounted on the cross bar; and a handle on each collar and pivotal relative to the collar about a substantially vertical shaft and a substantially horizontal shaft.

18. The assembly of claim 17 wherein the handles are pivotally mounted on the cross bars for movement between locked and unlocked positions.

19. The assembly of claim 18 wherein the handles are held in the locked position solely by the user's weight.

20. The assembly of claim 18 wherein the handles each include a collar slidably mounted on the cross bar, and an arm pivotally mounted to the collar, the arm having a first end supporting the handgrip and a second end engageable with the cross bar when the handle is in the locked position.

21. The assembly of claim 17 wherein the handles include handgrips spaced forwardly from the cross bar.

22. The assembly of claim 17 wherein the handles engage a bottom surface of the cross bar to lock the handles in position and preclude sliding movement of the handles along the cross bar.

* * * * *